US007976616B2

(12) United States Patent
Alam

(10) Patent No.: US 7,976,616 B2
(45) Date of Patent: Jul. 12, 2011

(54) COMPOSITE DISCHARGE ELECTRODE

(75) Inventor: M. Khairul Alam, Athens, OH (US)

(73) Assignee: Ohio University, Athens, OH (US)

( * ) Notice: Subject to any disclaimer, the term of this patent is extended or adjusted under 35 U.S.C. 154(b) by 328 days.

(21) Appl. No.: 11/911,987

(22) PCT Filed: Apr. 19, 2006

(86) PCT No.: PCT/US2006/014618

§ 371 (c)(1),
(2), (4) Date: Oct. 19, 2007

(87) PCT Pub. No.: WO2006/113749

PCT Pub. Date: Oct. 26, 2006

(65) Prior Publication Data

US 2008/0190296 A1 Aug. 14, 2008

Related U.S. Application Data

(60) Provisional application No. 60/672,720, filed on Apr. 19, 2005.

(51) Int. Cl.
*B03C 3/41* (2006.01)

(52) U.S. Cl. ..... 96/83; 96/95; 96/97; 313/351

(58) Field of Classification Search ..... 96/69, 83, 96/95–97; 313/351, 352, 356, 357
See application file for complete search history.

(56) References Cited

U.S. PATENT DOCUMENTS

| | | | | | |
|---|---|---|---|---|---|
| 1,130,212 | A | | 3/1915 | Steere | |
| 2,593,869 | A | | 4/1952 | Fruth | |
| 3,765,154 | A | * | 10/1973 | Hardt et al. | 96/88 |
| 3,957,462 | A | * | 5/1976 | Schminke et al. | 96/97 |
| 4,194,888 | A | * | 3/1980 | Schwab et al. | 95/78 |
| 4,247,307 | A | | 1/1981 | Chang | |
| 5,066,313 | A | * | 11/1991 | Mallory, Sr. | 95/57 |
| 5,125,936 | A | * | 6/1992 | Johansson | 96/84 |
| 5,254,155 | A | * | 10/1993 | Mensi | 96/44 |
| 5,707,428 | A | | 1/1998 | Feldman et al. | |
| 5,792,243 | A | * | 8/1998 | Meffert et al. | 96/83 |
| 6,077,334 | A | * | 6/2000 | Joannou | 96/66 |
| 6,231,643 | B1 | * | 5/2001 | Pasic et al. | 95/75 |
| 6,497,754 | B2 | | 12/2002 | Joannou | |
| 6,506,238 | B1 | * | 1/2003 | Endo | 96/79 |
| 6,527,829 | B1 | * | 3/2003 | Malkamaki et al. | 95/71 |
| 6,632,267 | B1 | * | 10/2003 | Ilmasti | 95/59 |
| 2004/0226448 | A1 | * | 11/2004 | Griffiths et al. | 96/67 |

FOREIGN PATENT DOCUMENTS

| | | | | | |
|---|---|---|---|---|---|
| GB | 1458952 | | 12/1976 | | |
| JP | 56-37061 | A | * | 4/1981 | 96/97 |

* cited by examiner

*Primary Examiner* — Richard L Chiesa

(74) *Attorney, Agent, or Firm* — Jason H. Foster; Kremblas & Foster

(57) ABSTRACT

The invention is a discharge electrode in an electrostatic precipitator having a power supply connected to at least one collection electrode and a flow of gas across the collection electrode. The discharge electrode has a plurality of conductive fibers electrically connected to the power supply and fiber tips exposed to the flow of gas. The fiber tips preferably extend from a composite in which the fibers reinforce a matrix material, but alternatively can be a large number of filaments extending from a composite rod.

35 Claims, 6 Drawing Sheets

Table I: V-I Characteristics of the Different Pairs

| Electrode (Pre-Charging) | Electrode (Charging) | Current (mA) @ 20kV | Current (mA) @ 25kV | Current (mA) @ 30kV | Current (mA) @ 35kV | Spark-over (kV) |
|---|---|---|---|---|---|---|
| All Stainless Steel | (i) All Stainless Steel | 0.10 | 0.16 | 0.26 | 0.45 | >35 |
| All Stainless Steel | (ii) SS "Ninja Stars" on Fiberglass Rod | 0.11 | 0.15 | 0.24 | N/A | >33 |
| All Stainless Steel | (iii) SS "Ninja Stars" on Carbon Composite Rod | 0.10 | 0.16 | 0.24 | N/A | >34 |
| Carbon Fiber PMC on Carbon Composite Rod | (iv) Carbon Fiber PMC on Carbon Composite Rod | 0.16 | 0.26 | 0.41 | N/A | >34 |
| Carbon Fiber Mat on Carbon Composite Rod | (iv) Carbon Fiber Mat on Carbon Composite Rod | 0.18 | 0.28 | 0.50 | 1.50 | >35 |

FIG. 9

Table II: Particle Collection Efficiency for 5 Minutes of Collection @ 25kV

| | Electrode (Charging) | Electrode Field | Current (mA) @ 20kV | Particle Mass Collected |
|---|---|---|---|---|
| (i) | Stainless Steel | Stainless Steel | 0.10 | 0.16 |
| (ii) | Stainless Steel | SS "Ninja Stars" on Fiberglass Rod | 0.11 | 0.15 |
| (iii) | Stainless Steel | SS "Ninja Stars" on Carbon Composite Rod | 0.10 | 0.16 |
| (iv) | Carbon Fiber PMC on Carbon Composite Rod | Carbon Fiber PMC on Carbon Composite Rod | 0.16 | 0.26 |
| (v) | Carbon Fiber Mat on Carbon Composite Rod | Carbon Fiber Mat on Carbon Composite Rod | 0.18 | 0.28 |

FIG. 10

COMPOSITE DISCHARGE ELECTRODE

This application is the national stage of International Application No. PCT/US06/14618, filed on Apr. 19, 2006, which claims priority to U.S. Provisional Application Ser. No. 60/672,720, filed Apr. 19, 2005.

BACKGROUND OF THE INVENTION

The invention relates generally to electrostatic precipitators (ESPs), and more particularly to a discharge electrode for an ESP.

DESCRIPTION OF THE RELATED ART

Charging electrodes are critical components used in electrostatic precipitators (ESPs), which are devices used to collect particles from gas streams, such as the streams from electric power plants burning coal. An example of such a device is shown in U.S. Pat. No. 6,231,643 to Pasic, et al., which is incorporated herein by reference.

The most basic ESP contains a row of wires followed by a stack of spaced, planar metal plates. A high-voltage power supply transfers electrons from the plates to the wires, developing a negative charge of thousand of volts on the wires relative to the collection plates. In a typical ESP, the collection plates are grounded, but it is possible to reverse the polarity.

The gas flows through the spaces between the wires, and then passes through the rows of plates. The gases are ionized by the charging electrode, forming a corona. As particles are carried through the ionized gases, they become negatively charged. When the charged particles move past the grounded collection plates, the strong attraction causes the particles to be drawn toward the plates until there is impact. Once the particles contact the grounded plate, they give up electrons, and thus act as part of the collector. Automatic "rapping" systems and hopper evacuation devices remove the collected particulate matter while the ESPs are being used, thereby allowing ESPs to stay in operation for long periods of time. Precipitators can fail once a very heavy buildup of waste material forms on the plates. The buildup can block airflow or bridge across insulating gaps and short out the high-voltage power supply.

The ESP has evolved as discharge electrodes have been developed, such as rigid discharge electrodes to which many sharpened spikes are attached, maximizing corona production. ESPs perform better if the corona is stronger and covers most of the flow area so particles cannot flow around the charging zones and escape being charged, which is called "sneakage".

Conventional discharge electrodes are supported on a metal structure, which typically includes a support rod. The rods are conductive in order to electrically connect each spike point with the power supply. Generally, it is considered necessary to have metal spikes that can withstand the electrical currents that often flow due to sparking over between the collection substrate and discharge electrode. The sharp spikes of the charging electrodes are also typically made of an expensive alloy to avoid or mitigate corrosion in the harsh environments in which such electrodes are used. The entire discharge electrode, including the rod, is commonly made of the alloy, causing the electrodes to be expensive and heavy, thereby requiring strong support structures.

Polymers are inexpensive, light and corrosion-resistant, but they do not conduct electricity, and they have poor tensile/flexural strength. Even conductive composites have much lower conductivity than metals. Therefore, the need exists for a discharge electrode that is lightweight and inexpensive, but still has a sufficient current flow and particle collection efficiency.

BRIEF SUMMARY OF THE INVENTION

The object of the invention is to replace part or all of the conventional charging electrode system with new materials focusing on carbon fibers, ceramic fibers (e.g., silicon carbide, and glass fibers), and metal fibers. The disadvantages of the state-of-the-art that are overcome by the invention include a reduction in cost and weight, and an improvement in charging characteristics and collection efficiency.

Polymer composites can be designed to be conductive and strong enough to function as a discharge electrode. The invention uses materials, such as plastic or glass and carbon fiber reinforced composites, for the discharge electrode support structure to reduce weight, eliminate corrosion and reduce cost. The discharge electrodes are commonly mounted on a support structure, such as a rod. Additionally, metal, conducting fiber mat or fiber reinforced composites are used for the electrodes. Preferably, the electrode is made of a mat or a composite that includes carbon fiber or carbon nanofiber, and has a simple or conventional discharge electrode shape, such as a star or circular disk shape.

In one embodiment of the invention, a woven carbon fabric or carbon fibers is stiffened with a polymer and hardened into a circular composite disk. The carbon fibers can be about 5 to 10 micrometers in diameter. In this embodiment, the conducting carbon fibers serve as the electrode discharge points. Since the number of discharge points is extremely large, on the order of hundreds, thousands or even hundreds of thousands of points per linear foot, significant improvements were achieved in the discharge behavior.

The flexibility of fibers make them amenable to forming of the electrodes into different shapes and orientations that can produce a more uniform corona and reduce sneakage. It is also contemplated to sandwich carbon fiber or other conducting fiber mat between two discs, and it is alternatively contemplated to bond fiber or mat to a disc so that the advantages of the carbon fiber mat can be combined with the stiffness of a solid disc without forming a composite matrix around the fiber mat. The discs around the mat can be metal, polymer or plastic. In another contemplated embodiment, a woven carbon fabric is partially reinforced by a polymer.

During the course of experimenting with the conductive composite and woven sheet electrodes, it was discovered that the fibers of the fiber mat and fibers in the composite disc act as small, sharp discharge points in place of the pointed spikes of the prior art to vastly improve the discharge characteristics of the electrode. Simple shapes, as opposed to elaborate, star-shaped electrodes made of an expensive alloy, may be adequate for a discharge electrode.

It was expected that the use of composites, which have lower conductivity than metal, would result in the same or lower collection efficiency and current flow. Instead, the composites worked significantly better, as shown by the experimental data. The corona current and the collection efficiencies were observed to be much better with the invention than the prior art.

It is theorized that the fibers act as sharp points in the place of the "star" shaped electrodes, or other pointed shapes of the prior art. Because there are thousands of fiber tips per linear foot, the results were much better than with a prior art electrode with perhaps 10, but at least fewer than 100, points per foot. The carbon fibers are about five microns in diameter, and are clustered, in one example, in tows that are woven to form a fabric mat. Each tow of woven carbon fabric is about one millimeter in diameter, and typically has about 3,000 to 12,000 filaments. Thus, each fiber forms a very sharp point, and there are many such sharp points at the surface of the electrode.

Although the small fibers could be damaged due to sparkover, the deposition of metal on the fiber tips would avoid this problem. Additionally, it is contemplated to mold metal needles or filaments into the disks or through the support rod in alternative embodiments. Instead of using conventional carbon fibers, it is possible to use carbon nanofibers or nanotubes which are much smaller in diameter. Metal or ceramic fibers, whiskers, or nanowires can also be used. Such materials can be placed within a composite electrode so that there are many tips of conductive fibers evenly distributed around the electrode, thereby producing a uniform corona.

BRIEF DESCRIPTION OF THE SEVERAL VIEWS OF THE DRAWINGS

FIG. 9 is a table containing experimental data.

FIG. 10 is a table containing experimental data.

Figure 1:
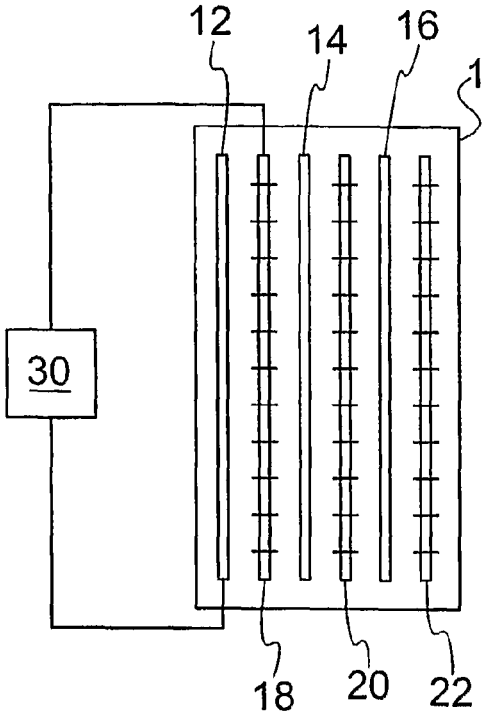
FIG. 1 is a schematic view illustrating the present invention in an electrostatic precipitator.

In describing the preferred embodiment of the invention, which is illustrated in the drawings, specific terminology will be resorted to for the sake of clarity. However, it is not intended that the invention be limited to the specific term so selected and it is to be understood that each specific term includes all technical equivalents that operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

In FIG. 1 an ESP is shown schematically having a housing 10, which can be a flue gas chimney, a plurality of planar collection electrode plates 12, 14 and 16, and a plurality of discharge electrodes 18, 20 and 22. The discharge electrodes and collection plates are supported by a frame (not shown), which can be integral with the housing 10, and are electrically connected to a power supply 30. Gases, such as flue gases containing flyash particles, flow through the housing 10 in a flow path across the plates 12-16 and the discharge electrodes 18-22, which function according to the principles discussed herein, and with much improved performance over the prior art due to the improvements to the discharge electrodes 18-22.

Figure 2:
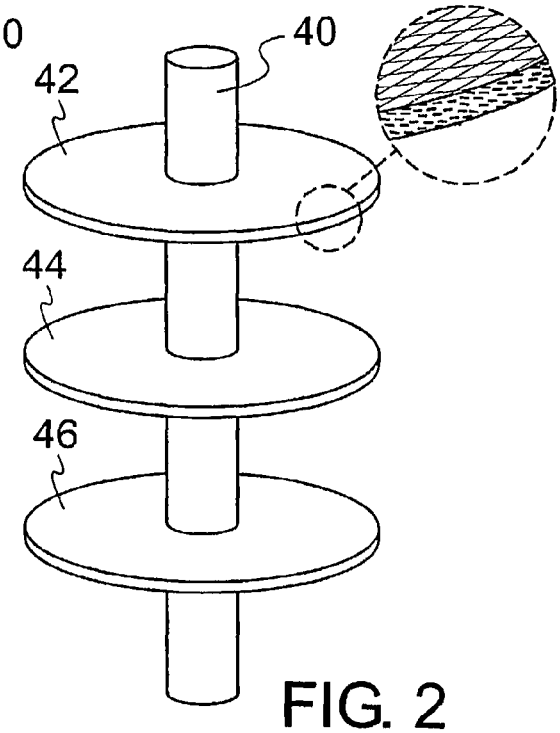
FIG. 2 is a schematic view in perspective illustrating a discharge electrode according to the present invention, with an edge magnified.

Each discharge electrode system, an example of which is shown schematically in FIG. 2, has a supporting rod 40 that supports a plurality of fiber composite discharge electrode plates, such as the circular disks 42, 44 and 46, spaced along the length of the rod. The rod 40 is preferably a lightweight plastic or polymer/fiber composite that is corrosion-resistant, strong and lightweight, especially as compared to the prior art metal support rods. The discharge electrodes can be as simples as a disc shape, or can be molded into a complex geometry when using a fiber based composite.

In a first contemplated embodiment, which is not illustrated separately because the differences in materials relative to the embodiment of FIG. 2 are not apparent from an illustration, the supporting rod is made of non-conducting, tubular plastic, such as PVC. A conductor, such as a copper wire (not shown), extends through a central passage in the supporting rod and attaches mechanically and electrically to each of the disks. By remaining within the tubular plastic the conductor is not exposed to the harsh flue gases but still contacts the disks, which have outer surfaces electrically connected to the conductor.

In a second contemplated embodiment, the supporting rod is a composite that is non-conductive, such as glass fiber reinforced polymer, with a similar conductor extending through a central passage in the rod to electrical connection to each of the disks.

In a third contemplated embodiment, the rod is a conductive composite with some or all of the reinforcing fibers in the rod made of conducting material. For example, all of the reinforcing fibers of the rod can be made of carbon fibers or nanofibers. Alternatively, some of the reinforcing fibers can be made of carbon fibers, and some of the fibers can be made of glass, silicon carbide, metal or other materials. It will be understood that the fibers can be one or any combination of conductive and non-conductive fibers, including, but not limited to, metal fibers. The fibers can be filaments, nanofibers, nanotubes or nanowires. For example, carbon nanotubes, SiC fibers or SiC whiskers can also be used. For thermal stability, high temperature polymers or ceramics can be used as the matrix material in the composite.

In a fourth contemplated embodiment, the rod has non-conductive fibers, such as glass fibers, and particulate, such as conductive metal flakes, carbon flakes or any other conductive particulate, in the matrix material of the rod.

The disks 42-46 preferably contain fibers that are conductive, such as carbon, silicon carbide, metal or any other conductive material. The person of ordinary skill will recognize that there are other materials, or other materials that may come into existence, that are conductive and would be suitable for use in the invention. However, merely because such other materials are not listed herein is not intended to suggest that no other materials exist that could substitute for those listed herein.

The disks 42-46 are preferably a carbon fiber composite with a non-conducting matrix material, such as cured epoxy resin or polyester. Disks of the size contemplated, which is about two inches in diameter and one-eighth inch thick, have hundreds of fibers per disk. More typically, such disks have tens or hundreds of thousands of fibers in each disk. For example, carbon fiber mats are commonly made of tows of fibers woven into a mat, and each tow has typically 3,000 to 12,000 fibers. Thus, a woven mat with one hundred tows of fibers has hundreds of thousands of fibers. It is contemplated that one can easily make a disk having one million points per foot, or point densities orders of magnitude higher.

The disks 42-46 are preferably made by infiltrating a planar, woven fiber mat or preform with a liquid or semi liquid material, such as a polymer, that cures or solidifies (such as by cooling a thermoplastic) to form a hard, non-conducting matrix that is reinforced by the fibers. The cured composite can be shaped into a planar panel or other configurations to produce a uniform corona for efficient charging of the particles. In the simplest configuration, the planar panel is cut into preferably circular disks, for example using a conventional hole saw. The hole saw forms a circular outer edge with a central aperture. The rod 40 is inserted into the central aperture, and the peripheral edge of the disk 40 is disposed radially away from the rod.

As the hole saw severs the fibers and matrix material of the cured composite panel, it exposes the tips of the fibers by cutting away matrix material. These fiber tips on the ends of the individual fibers are thereby exposed to the gas flow. In a preferred embodiment, each fiber is about 5 microns in diameter, and each fiber tip forms a sharp point that is exposed to the gas surrounding the electrode when the ESP is in operation. The points are evenly disposed around the peripheral edge of the disk as illustrated in the enlarged section of FIG. 2, and each fiber is electrically connected to the power supply 30 that creates the voltage across the collection plates and the discharge electrodes. Thus, the tips of the fibers make substantial contact with the flowing gas.

Figure 3:
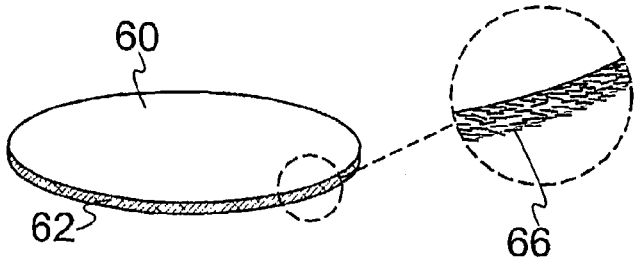
FIG. 3 is a view in perspective illustrating an alternative embodiment of the present invention with an edge magnified.

The fibers in the disks can be made of metal wire or other conducting fibers, and the disk need not be completely infiltrated with a cured matrix material. The fibers can be simply coated on the exterior to hold them together, or can be altogether uncoated. In the latter case, it is preferred that some mechanical means be used to prevent the fibers from fraying apart. The means can include rigid disks 60 and 62 that sandwich the mat 66 between them, but leave the tips of the fibers exposed, as shown schematically in FIG. 3. It should be noted that the fibers shown in FIGS. 2 and 3 are exaggerated in size in order to illustrate the position of their tips conceptually. These illustrations are not intended to accurately portray the sizes of the fibers.

The fiber ends can also be exposed on other parts of the disc (such as top and bottom surfaces), and it is preferred that as many tips as is practical be exposed to the gas flowing around the electrode. The fibers can be coated with metal or any other conductive material in order to protect the potentially fragile tips from wear and from sparkover damage. This coating can be formed by chemical vapor deposition or any other known metal deposition process.

Figure 4:
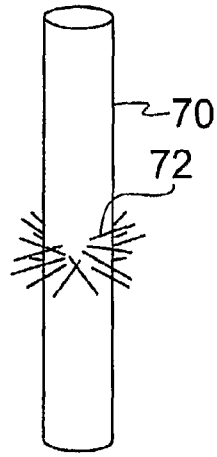
FIG. 4 is a view in perspective illustrating an alternative embodiment of the present invention.
Figure 12:
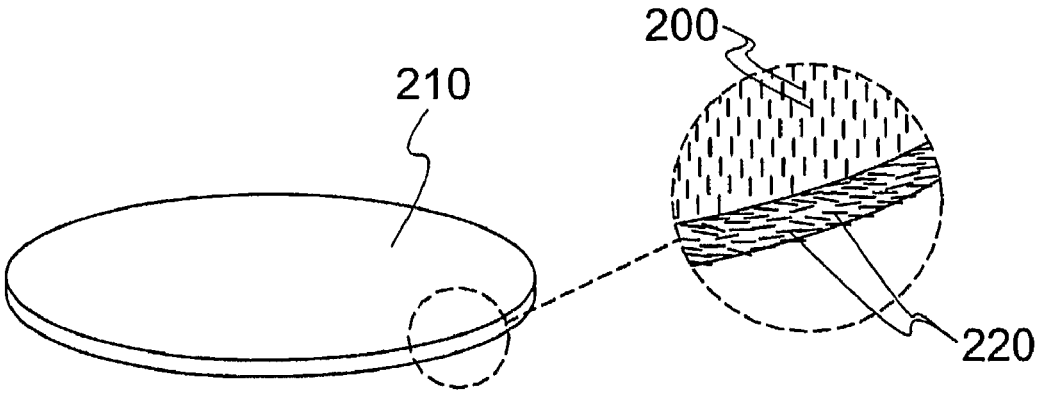
FIG. 12 is a schematic view in perspective illustrating an alternative embodiment of the invention.

In an alternative embodiment, a plurality of fine conductive filaments or needles 72 is molded into the rod or into a disc mounted along the supporting rod 70 as shown in FIG. 4. These filaments extend from the rod 70, and connect electrically to the power supply (not shown). The filaments or needles 72 have tips exposed to the gas flowing past the discharge electrode. The filaments or needles 72 can operate as the main electrode, or can supplement any of the disks discussed herein. An example of the latter is shown in FIG. 12, in which short filaments 200 extend from a disk 210 perpendicular to the disk surface in addition to the fibers 220 that extend from the edge of the disk 200.

Figure 11:
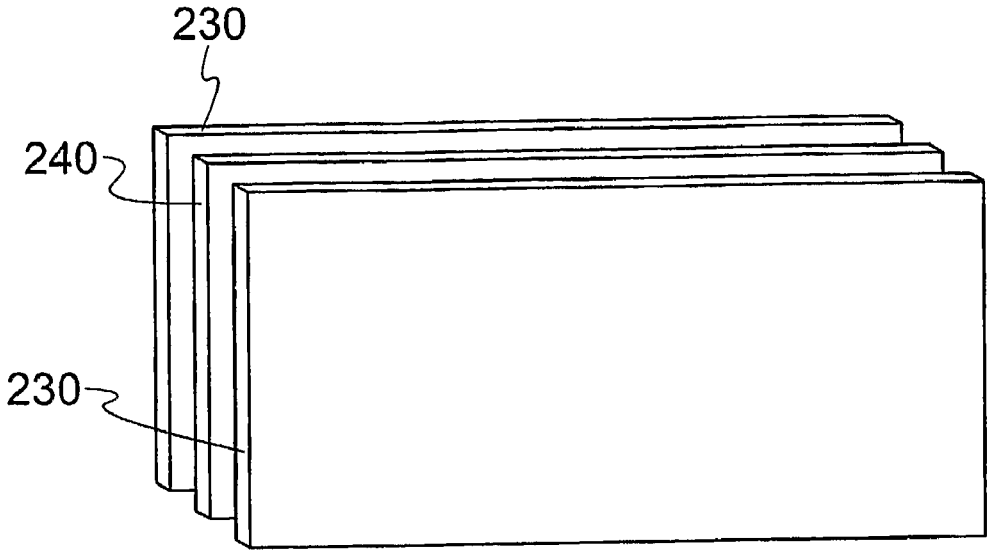
FIG. 11 is a schematic view in perspective illustrating an alternative embodiment of the invention.

In an alternative embodiment, the discharge electrode can be made by forming a cured composite block with conductive fibers in the composite, and cutting the block to form planar sheets or disks that are mounted to supporting rods. Alternatively, the sheets can be used without a supporting rod by simply aligning the planar sheets 230 parallel to the collecting plates 240 in the ESP as shown in FIG. 11. It is important to note that a substantial portion of the fibers in the discharge electrodes should be exposed at their tips to the gas flow so that the gases can be ionized and particles become charged as they flow in the ESP. The fibers in the planar sheets used alone as discharge electrodes can be transverse, and even perpendicular, to the plane in which the planar sheet electrode is contained. However, some fibers may be parallel to the plane, such as those on the edges of the sheet.

Because polymers and reinforced polymers (i.e., composites) are lighter in weight than conventional metal electrodes and support rods, the use of these materials can reduce the cost of the support structure necessary to hold the discharge electrodes in the ESP. The fibers used in these composites are very stiff and strong, and therefore the composites are very stiff, which is necessary in an ESP.

The invention thus uses sheets, rods and tubes made of polymers and fibers, or fiber reinforced polymer matrix composites to form the discharge electrodes and the support structures for the discharge electrodes. It is, of course, possible to construct a discharge electrode using a mixture of the exemplary structures described above. For example, it is contemplated that a composite supporting rod can be used with conventional metal plates to form a discharge electrode. Alternatively, composite disks can be used with metal supporting rods to form a discharge electrode.

The complete electrode and/or support structures can be molded in one piece using polymers and short fibers or nanofibers, for example to reduce costs associated with manufacturing. This is particularly applicable to short fiber composites that can be molded at low cost. Whiskers, nanofibers, nanotubes, and nanowires can be molded into a composite. The short fibers can be glass fiber with carbon fiber or nanofiber, or carbon fiber or nanofiber alone. If necessary, a fiber preform can be used.

As noted above, the fiber reinforcements can be carbon fiber, silicon carbide, and glass fibers. The discharge electrode is made of materials that include one or a combination of fiberglass reinforced polymer, carbon fiber reinforced polymer, carbon fiber, carbon fiber mat, carbon-carbon composite, composites with electrically conducting materials such as metals and conducting fibers. The carbon fiber may be conventional PAN/PITCH fiber, nanofiber, nanotube, or other morphologies.

It should be noted that the carbon fibers can be selected that are good conductors of electricity. Other fibers, such as silicon carbide fiber can conduct electricity and resist high temperature. Non-conducting fibers, such as glass fibers, can be combined with conducting fibers, such as carbon fibers, to tailor the conductivity to that desired. For example, testing has indicated that the resistivity of the electrode can be as high as 100 Ω-cm, as compared to steel, which is around $3\times10^{-5}$ Ω-cm. It is preferred that the resistivity be lower than 100, but with the invention, it is possible to have discharge electrodes with resistivity as high as 100 Ω-cm.

In another embodiment, a continuous carbon fiber based composite, such as a pultruded rod, is used for the support rod. A hybrid composite using carbon fiber and glass fiber is used in another embodiment. A 100% fiberglass composite rod can be used with a metal conductor, and carbon nanofibers can be mixed with continuous glass fiber or chopped glass fiber. For example, one percent (1%) or more of carbon nanofiber can provide the conductivity needed for the electrode. It is also contemplated to use silicon carbide (SiC)

fibers instead of carbon fibers in the above configurations. Metal or ceramic matrix composite electrodes can also be fabricated.

It is contemplated to use a carbon nanofiber mat with a binder, or a composite with carbon fiber, especially for the discharge electrodes including the spikes. The composite discharge electrodes can be made in simple shapes or complex shapes, such as spikes.

The support system from which the electrode array is suspended can also be made of polymer composite to take advantage of the lighter weight of the electrodes and the lower cost of polymer composites. A polymer composite of virtually any type can be made conductive by adding conductive fibers or particles.

A very stiff supporting rod is constructed by combining non-conducting polymers, or a fiberglass-polymer composite, with inexpensive short carbon fibers, such as VGCF or nanofibers. An inexpensive solution for making such a stiff, conducting 'backbone' is to extrude a polymer with nanofiber reinforcements into a composite rod. The composite rod can be extruded inside a larger tube for reinforcement to produce a very stiff rod that conducts electricity. Still further, a hybrid system can be made with a mixture of glass fiber, carbon fiber and nanofiber.

It should also be noted that one can make complex electrode shapes by molding polymer with carbon fiber, including nanofiber, flakes or other conducting particles or whiskers to make the electrode conductive. One cost-effective product is made from carbon nanofiber mixed with a fiberglass composite. The use of nanofiber with a short glass fiber has advantages, as does the use of continuous glass fibers, including metal and glass, in composites. With continuous metal fibers, the nanofiber can be added to create or enhance transverse conductivity. With glass fiber, nanofiber adds or creates transverse and longitudinal conductivity.

The inventor created several experimental discharge electrodes and tested them in order to quantify the differences between a conventional discharge electrode and discharge electrodes made according to the invention. Short electrodes were designed and fabricated for comparative testing in pairs.

Figure 5:
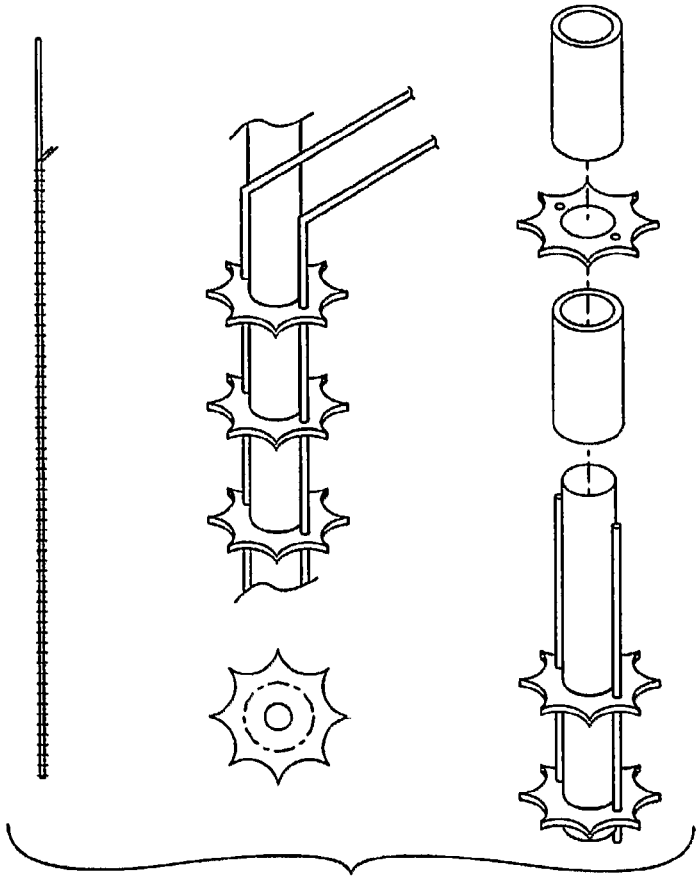
FIG. 5 is a view in perspective illustrating a discharge electrode with a portion magnified to show specific detail, an exploded view of the discharge electrode and a top view of the electrode of the discharge electrode.
Figure 6:
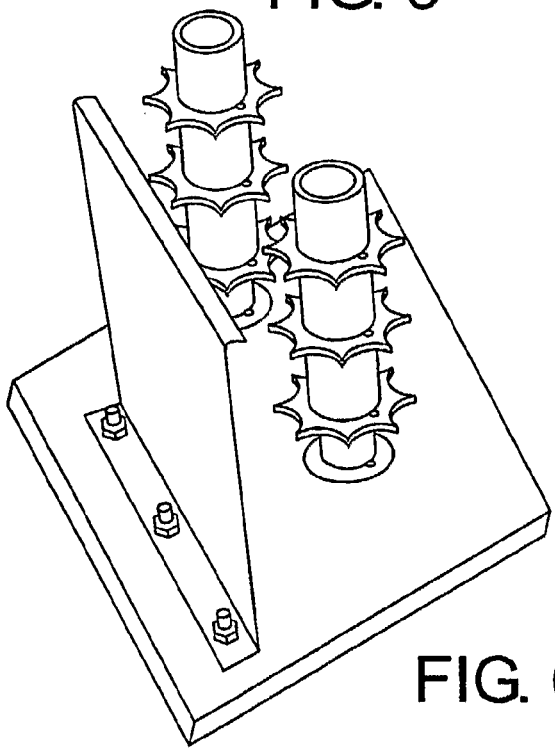
FIG. 6 is a view in perspective illustrating the experimental equipment.

The first set of experimental discharge electrodes, referred to as "all-stainless steel" in the appended tables, was made of a stainless steel tube with "ninja star" shaped discharge electrode discs tack-welded on the tube, as shown in FIGS. 5 and 6. These stars are virtually identical in structure to electrodes used in some conventional ESPs. The electrodes were then put together in a laboratory ESP configuration with a collection plate as shown in FIG. 6. This formed the baseline for comparison. The electrode system with the collection plate was then placed inside the laboratory ESP system and experiments were conducted to compare its performance to that of replacement discharge electrodes that were made according to the invention.

The conventional all-stainless steel electrode system was replaced with the four different configurations described below in order to compare the configurations using the invention with the baseline conventional discharge electrode. In all cases of the replacement discharge electrodes, a fiber reinforced polymer composite rod was used as the stiff 'backbone' support rod for the electrode. Metal and composite plates were attached to this backbone, spaced about two inches apart, by using polymer tubes, such as PVC pipes. To make the electrical connection with the electrodes on a non-conducting fiberglass composite rod, a wire or ribbon of the same material as the discharge electrode was used as shown in FIG. 5. The wire extended through a hole in the electrode and was tack-welded on the metal disks and glued on the composite disks. The spacer tubes were bonded to the rod to improve the stiffness and the stability of the system.

In the first replacement discharge electrode made according to the invention, referred to in the tables as "SS ninja-stars on fiberglass rod", stainless steel "ninja star" disc electrodes were attached to a fiberglass backbone with a connecting metal wire as shown in FIG. 5.

Figure 7:
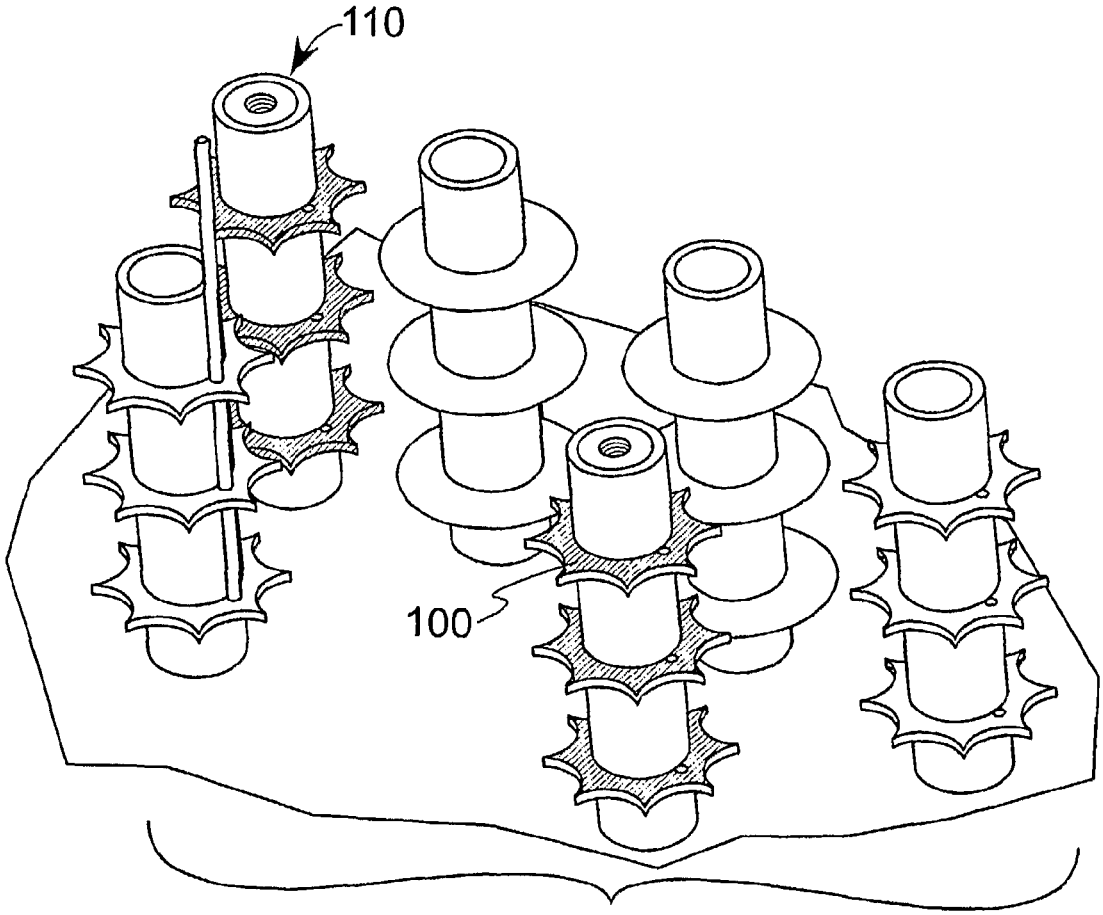
FIG. 7 is a view in perspective illustrating a plurality of discharge electrodes used in the experiments.

In the second replacement discharge electrode, referred to in the tables as "SS ninja-stars on carbon composite rod", stainless steel "ninja star" disc electrodes were mounted on a carbon fiber-polymer matrix composite (PMC) rod as shown in FIG. 7 at reference numeral 100. The composite rod is conductive and is bonded to the metal electrodes. The conducting backbone rod can be a pultruded carbon composite rod/tube and attached to the discharge electrode using a conductive paste, such as graphite-filled epoxy. This example eliminates the need to use metal wire conductors, which are subject to corrosion problems. Spacers were used to hold the discs in place.

In a third replacement discharge electrode, referred to in the tables as "Carbon fiber PMC on carbon composite rod", carbon fiber-polymer matrix composite were cut into "ninja star" shapes and bonded on a carbon fiber polymer matrix composite rod backbone as shown in FIG. 7 at reference numeral 110. In this example, the electrodes themselves were made of composites that are conducting, and the supporting rod and electrodes were made of non-metallic, conducting materials. The electrode disks were bonded to the rod using a conductive epoxy or similar material. This composite disc was machined so that a number of sharp points were produced, thereby simulating the "ninja star" shape of the conventional metal electrode. It is important to note that the fibers in the star-shaped composite disc themselves acted as small, sharp points to improve the charging characteristics of the electrode.

In the fourth replacement, referred to in the tables as "Carbon fiber mat on carbon composite rod", the "ninja star" discs were replaced by a carbon fiber mat cut into a circular disc. The discs were mounted on a carbon fiber polymer matrix composite rod and separated by spacers as shown by reference numeral 120 in FIG. 8. In this embodiment, both the backbone support rod and the electrodes were made of carbon fiber reinforced materials. These electrodes were bonded to the backbone rod.

Figure 8:
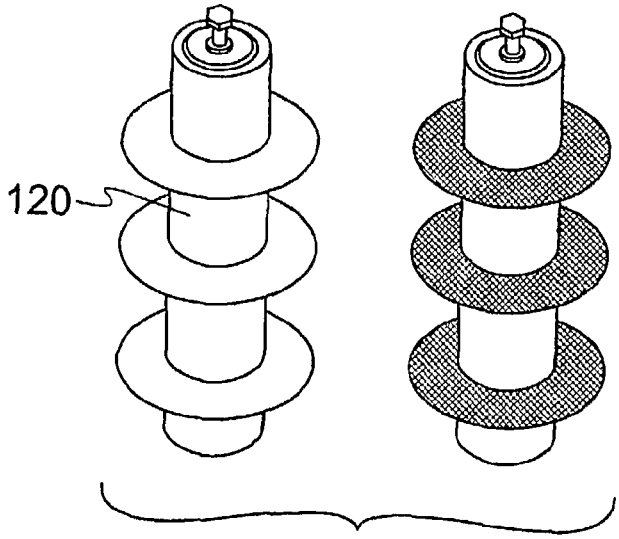
FIG. 8 is a view in perspective illustrating another discharge electrode used in the experiments.

All electrodes had the same disc diameter and support rod diameter. The collection of different electrodes that was fabricated and tested is shown in FIGS. 7 and 8. Electrodes of the simple disc shape are shown in FIG. 8. A carbon-carbon composite, such as a carbon-carbon composite disc, can be used as the electrode. Since such materials have very high electrical and thermal conductivity, the electrodes will remain colder. This will reduce the chances of electrode damage due to sparking.

The results of the tests carried out to determine the V-I characteristics and the collection efficiency are shown in the tables of FIGS. 9 and 10. The tests were performed under identical geometrical and flow conditions. The spark-over voltage was noted. The results show that composite electrodes performed better by providing higher current and higher collection efficiency. The metal electrodes performed equally well when the supporting rod was metal, fiberglass reinforced polymer or carbon fiber reinforced polymers. The experimental results show that carbon fibers and carbon fiber composite electrodes produce high discharge current and higher collection efficiency, even with simple shapes. Tests have shown that simple shapes will work and provide high collection efficiency.

It should be noted that if it is desired to have a different point density than that described above, the point density can be tailored to be anywhere from one hundred to many millions, depending simply upon the number of conducting fibers in the electrodes. Furthermore, if the current flow is desirably lower than that shown, one can simply operate the invention at a lower voltage. It is known from the experimental results that with the invention one can achieve the same current as the prior art at a lower voltage.

While certain preferred embodiments of the present invention have been disclosed in detail, it is to be understood that various modifications may be adopted without departing from the spirit of the invention or scope of the following claims.

The invention claimed is:

1. A discharge electrode in an electrostatic precipitator having a power supply connected to at least one collection electrode and a flow of gas across the discharge electrode and the collection electrode, the discharge electrode comprising:

(a) a composite support rod mounted to a frame and made of reinforcing fibers infiltrated with a solid, non-conductive matrix;

(b) at least one composite plate made of reinforcing fibers infiltrated with a solid matrix, the plate being mounted to the support rod and having a peripheral edge, wherein at least some of the reinforcing fibers are conductive and are electrically connected to the power supply;

wherein at least a portion of the plate edge is formed by a plurality of tips of at least some of the conductive reinforcing fibers embedded in the composite plate, said tips being exposed to the flow of gas at the edge of the plate to produce a corona for ionization of substances in the flow of gas.

2. The discharge electrode in accordance with claim 1, wherein the discharge electrode has a point density of at least 10 discharge points per linear foot.

3. The discharge electrode in accordance with claim 2, wherein the point density is at least 100 discharge points per linear foot.

4. The discharge electrode in accordance with claim 2, wherein the discharge points are tips of conductive fibers.

5. The discharge electrode in accordance with claim 4, wherein the fiber tips extend from peripheral edges of the composite plate mounted to the rod.

6. The discharge electrode in accordance with claim 5, wherein the fibers are metal.

7. The discharge electrode in accordance with claim 6, wherein the fibers are nanowires.

8. The discharge electrode in accordance with claim 5, wherein the fibers are non-metal.

9. The discharge electrode in accordance with claim 8, wherein the fibers are carbon.

10. The discharge electrode in accordance with claim 9, wherein the carbon fibers are nanofibers.

11. The discharge electrode in accordance with claim 9, wherein the carbon fibers are nanotubes.

12. The discharge electrode in accordance with claim 8, wherein the fibers are ceramic.

13. The discharge electrode in accordance with claim 12, wherein the fibers are whiskers.

14. The discharge electrode in accordance with claim 5, wherein the plate is substantially circular.

15. The discharge electrode in accordance with claim 8, further comprising a coating of metal over at least some of the tips of the fibers.

16. The discharge electrode in accordance with claim 4, wherein the rod is electrically conductive.

17. The discharge electrode in accordance with claim 16, wherein the rod is a polymer with at least one conductor.

18. The discharge electrode in accordance with claim 1, wherein reinforcing fibers in the composite rod are carbon fibers that are electrically connected to the power supply and the conductive fiber tips.

19. The discharge electrode in accordance with claim 4, wherein the rod is an electrically non-conductive material.

20. The discharge electrode in accordance with claim 19, wherein the rod is a fiberglass tube.

21. The discharge electrode in accordance with claim 19, further comprising at least one electrical conductor on the rod electrically connecting the power supply and the conductive fiber tips.

22. The discharge electrode in accordance with claim 4, wherein the conductive fibers extend from the peripheral edges of a fibrous sheet mounted to the supporting rod.

23. The discharge electrode in accordance with claim 22, wherein the sheet contains metal fibers.

24. The discharge electrode in accordance with claim 22, wherein the sheet contains non-metal fibers.

25. The discharge electrode in accordance with claim 24, wherein the sheet is clamped between two panels.

26. The discharge electrode in accordance with claim 22, wherein the sheet further comprises a binder on at least some of the fibers for adhering adjacent fibers together.

27. The discharge electrode in accordance with claim 4, wherein the conductive fibers extend through the support rod.

28. The discharge electrode in accordance with claim 4, wherein the conductive fibers extend through the electrode.

29. The discharge electrode in accordance with claim 27, wherein the conductive fibers further comprise needles extending through the support rod.

30. The discharge electrode in accordance with claim 4, wherein the conductive fibers further comprise needles attached to the support rod.

31. The discharge electrode in accordance with claim 4, wherein:

(a) the support rod is a glass fiber and polymer composite mounted to a frame; and (b) at least one composite plate is mounted to the support rod with the conductive fibers electrically connected to the power supply and extending with fiber tips from peripheral edges of the plate, thereby exposing the tips to the flow of gas.

32. The discharge electrode in accordance with claim 31, wherein the discharge electrode has a point density of at least 10 points per linear foot.

33. The discharge electrode in accordance with claim 1, wherein:

the support rod is a glass fiber and polymer composite mounted to a frame.

34. The discharge electrode in accordance with claim 33, further comprising a conductor extending along the support rod.

35. The discharge electrode in accordance with claim 33 further comprising a conductor extending inside the support rod.

* * * * *